United States Patent [19]

Schwank

[11] 3,972,675

[45] Aug. 3, 1976

[54] PROCESS FOR DYEING SKINS AND FURS

[75] Inventor: Max Schwank, Basel, Switzerland

[73] Assignee: Ciba-Geigy AG, Basel, Switzerland

[22] Filed: July 11, 1974

[21] Appl. No.: 487,700

Related U.S. Application Data

[63] Continuation of Ser. No. 298,034, Oct. 16, 1972, abandoned, which is a continuation of Ser. No. 94,544, Dec. 2, 1970, abandoned.

[30] Foreign Application Priority Data

Dec. 3, 1969 Switzerland ..... 18006/69

[52] U.S. Cl. ..... 8/10; 8/1 K; 8/88; 8/89 R; 8/93

[51] Int. Cl.[2] ..... D06P 3/00

[58] Field of Search ..... 8/1 K, 10, 88, 89, 93

[56] References Cited

UNITED STATES PATENTS

| | | | |
|---|---|---|---|
| 3,352,755 | 11/1967 | Lerner | 167/88 |
| 3,726,636 | 4/1973 | Baderscher et al. | 8/83 |

FOREIGN PATENTS OR APPLICATIONS

| | | | |
|---|---|---|---|
| 872,506 | 7/1961 | United Kingdom | 8/10 |
| 856,381 | 12/1960 | United Kingdom | 8/10 |

*Primary Examiner*—Melvyn I. Marquis
*Attorney, Agent, or Firm*—Joseph G. Kolodny; Edward McC. Roberts; Prabodh I. Almaula

[57] ABSTRACT

A new process for dyeing furs and skins below 70°C is provided, which process is carried out with aqueous dyebaths containing a dyestuff, up to 15 g per liter of the whole preparation of an organic non-ionizable oxo compound with only limited solubility in water and optionally an emulsifier for these compounds.

According to this process furs and skins can be dyed in deep and level shades with a broad scope of dyestuffs without any pretreatments for improving the dye-receptivity of the substrates.

11 Claims, No Drawings

PROCESS FOR DYEING SKINS AND FURS

This application is a continuation of U.S. application Ser. No. 298,034, filed Oct. 16, 1972, now abandoned, which is a continuation of U.S. application Ser. No. 94,544, filed Dec. 2, 1970, now abandoned.

It is known to dye furs and skins, especially sheepskins, at 60°C, maximally at 65° to 70°C. Higher temperatures cannot be used because of damage to the leather portion as a result of hardening and shrinkage. At this dyeing temperature, however, only a few selected dyestuffs, containing acid groups, can be dyed onto skins or furs, and attempts have thus been made to improve the dyeing properties of these substrates by a pretreatment with oxidising compounds, predominantly compounds which split off chlorine. However, the chlorination renders the hair on the skins and furs, especially the wool hair on the sheepskins, brittle and hard, so that this method is not used too frequently.

It has now been found that these difficulties can be avoided if aqueous tinctorial preparations are used for dyeing skins and furs, which in addition to containing a dyestuff suitable for dyeing material containing keratin, contain organic compounds which are non-ionisable and are at most of limited solubility in water, and which possess an oxo grouping, and optionally a levelling agent or dispersing agent.

Possible dyestuffs are water-soluble dyestuffs suitable for dyeing wool. This description is to be understood to include those dyestuffs with which wool can be dyed according to the customary exhaustion process. These dyestuffs contain carboxylic acid groups or especially sulphonic acid groups, or acid amide groups, acid sulphuric acid ester groups or alkylsulphone groups, as groups which impart solubility in water. They may be reactive or unreactive towards the material to be dyed and can, in other respects, belong to the most diverse classes of dyestuffs, such as for example those of the oxazine, triphenylmethane, xanthene, nitro or acridone dyestuffs, but especially to those of the metallised or metal-free monoazo and polyazo dyestuffs and of the anthraquinone dyestuffs. By reactive dyestuffs there are to be understood those dyestuffs which are capable of forming a chemical bond, that is to say a covalent bond, with the material to be dyed.

As examples there may be mentioned: complex chromium compounds of dyestuffs containing sulphonic acid groups, which contain one atom of chromium bonded to one dyestuff molecule; complex chromium compounds or cobalt compounds which are free of sulphonic acid groups and of carboxylic acid groups which do not participate in the complex formation, and in which two dyestuff molecules are bonded as a complex to one atom of chromium or cobalt; water-soluble dyestuffs, for example dyestuffs containing sulphonic acid amide groups or alkylsulphone groups can be used for this purpose; complex chromium compounds or cobalt compounds which contain, in the complex molecule, a single sulphonic acid group or a carboxylic acid group which does not participate in the complex formation, and in which two dyestuff molecules are bonded as a complex to one atom of chromium or cobalt; complex chromium or cobalt compounds which contain, in the complex molecule, more than one group which imparts solubility in water, and in which two dyestuff molecules are bonded as a complex to one atom of chromium or cobalt; reactive dyestuffs, for example those with monochlorotriazine or dichlorotriazine radicals, dichloropyrimidine or trichloropyrimidine radicals or $HO_3S—OCH_2CH_2$ groups, acrylamide or $\alpha$-halogenacrylamide groups or groupings which can be converted into these.

The preparations to be used in the present process furthermore contain at least one organic non-ionic oxo compound having at most limited solubility in water. In the case of these compounds, two groups are differentiated:

1. those which are practically water-insoluble and are used in amounts of 0.75 to 4 g/l, preferably 2 to 3 g/l, of dyeing liquor, and in the presence of an emulsifier;

2. those which have a solubility in water of up to about 15 g per liter of aqueous solution and are employed in the dyebath without emulsifier, in amounts of 5 to 15 g/l, preferably of 6 to 12 g/l of dyeing liquor.

The organic compounds containing oxo groups which are added to the tinctorial preparations can be aliphatic, alicyclic, aromatic or heterocyclic. The oxo grouping can occur as an isolated grouping in the molecule, but can also be a constituent of, for example, an ester or amide grouping. The following compounds may for example be mentioned: isophorone, acetophenone, tetralone, tetramethyltetralone, methylcyclohexanone, trimethylcyclohexanone, acetanilide, acetylaminophenol, acetyltoluidine, butyl phthalate, butyl acetate, tributyl phosphate and benzaldehyde.

The amounts of the surface-active assistants serving as the emulsifier, for emulsifying the practically water-insoluble compounds, depend in each case on the amount of these compounds and is about 5 to 20 %, preferably 10 to 18 %, relative to the organic compound.

The surface-active assistants used as emulsifiers can be non-ionic or ionic, that is to say cationic and anionic, compounds, which can be employed individually or as a mixture of auxiliaries.

Suitable representatives of such surface-active compounds belong to the following types of compound: ethers of polyhydroxy compounds, such as polyoxalkylated fatty alcohols, polyoxalkylated polyols, polyoxalkylated mercaptans and aliphatic amines, polyoxalkylated alkylphenols and alkylnaphthols, polyoxalkylated alkylarylmercaptans and alkylarylamines, and also the corresponding esters of these compounds with polybasic acids, such as sulphuric acid or phosphoric acid, optionally also in the form of ammonium salts or amine salts; fatty acid esters of ethylene glycol and polyethylene glycols, of glycerol and of sugar alcohols; N-hydroxyalkylcarbonamides and polyoxalkylated carbonamides. As examples there may be mentioned the reaction product of *p*-nonylphenol with 9 mols of ethylene oxide, the addition product of 8 mols of ethylene oxide to 1 mol of *p*-tert. octylphenol and the addition product of 7 mols of ethylene oxide to oleic acid.

As further assistants the dyebath can also contain resisting agents for the leather side of the furs, which are normally intended not to be dyed, or only slightly dyed, in such a dyeing process. The reaction products of naphthalene-sulphonic acid with formaldehyde may for example be mentioned as resisting agents.

For some classes of dyestuff, for example the 1:2 metal complex dyestuffs, it is advisable to add a levelling agent to the dyebaths of the present dyeing process.

These levelling agents are in themselves known and advantageously polyglycol ether derivatives of long-chain monoamines or diamines, wherein at least one nitrogen atom is substituted by the hydrocarbon radical of a long-chain fatty acid, are for example used; furthermore, these adducts can also be quaternised at a nitrogen atom or to be esterified with a polybasic acid at the end of a polyglycol chain, or can be both quaternised and esterified.

As starting substances, individual higher-molecular alkylamines or amine mixtures are used, such as are obtained on converting natural fatty acid mixtures, for example tallow fatty acid, into the corresponding amines. Amines with 16 to 22 carbon atoms, to which not more than 60 to 70 mols of ethylene oxide have been added, are suitable.

The following may for example be mentioned: the addition product of 8 mols of ethylene oxide to oleylamine, and the mixture of a) an adduct of 1 mol of tallow fatty amine (consisting of 30 % of hexadecylamine, 25 % of octadecylamine and 45 % of octadecenylamine) and 20 mols of ethylene oxide, quaternised with dimethyl sulphate and b) the ammonium salt of the acid sulphuric acid ester of the adduct of 1 mol of a fatty amine (consisting of 10 % of stearylamine, 55 % of arachidylamine and 35 % of behenylamine) and 30 mols of ethylene oxide.

The amount of levelling agent in the dyebaths is about 0.5 to 2 %, relative to the substrate to be dyed, and depends on the amount of dyestuff employed.

Dyeing is appropriately carried out in a weakly acid medium, so that the pH-value of the dyebath is about 3 to 6, preferably 3.5 to 5. This pH-value can advantageously be adjusted by formic acid or acetic acid, and if desired also by sulphuric acid. When dyeing in pastel shades it is advisable further to add buffer salts such as ammonium sulphate, sodium acetate or sodium hydrogen phosphates, to the dyebaths.

Advantageously, dyeing takes place by the exhaustion process at 55° to 60°C and, if the tanning of the skins and furs permits, also at 65° to 70°C. Suitable liquor ratios are approximately between 1:10 and 1:40.

An advisable pretreatment for the furs and skins which have normally been acid-tanned, such as for example sheepskins or rabbit skins, is a milling process for neutralising the substrates. This milling process can for example be carried out in an aqueous bath which contains sodium hydrosulphite, ammonia and optionally a surface-active auxiliary. In order to improve the fastness to washing and perspiration it is possible, after the substrates have taken up the desired amount of dyestuff, to raise the pH-value of the dye bath by addition of substances which react alkaline, such as ammonia, hexamethylenetetramine, sodium bicarbonate or triethanolamine.

The non-fixed dyestuff is then removed from the substrates, and especially also from the leather part, by washing and rinsing.

Thereafter, the dyed substrates are treated in a weakly acid bath and are optionally greased with fat liquor emulsions, for example of sulphated sperm oil, and then dried.

In the Examples which follow, the parts, unless otherwise noted, denote parts by weight and the percentages denote percentages by weight.

C.I. denotes Colour Index, second edition 1956, published by the Society of Dyers and Colourists, Bradford, England and The American Association of Textile Chemists and Colorists, Lowell, Mass., U.S.A.

EXAMPLE 1

100 parts of chrome-tanned sheepskins are neutralised for 2 hours, at 45°C, on a winch in a bath which contains 1 part of the reaction product of *p*-nonylphenol with 9 mols of ethylene oxide, 6 parts of sodium hydrosulphite and 4 parts of ammonia (24 % strength) in 2000 parts of water.

The sheepskins thus pretreated are dyed in 2000 parts of water which contain 1.4 parts of the dyestuff of formula

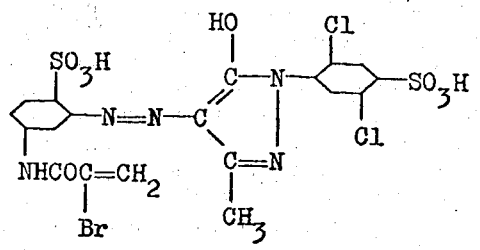

yellow 2.6 parts of the dyestuff of formula

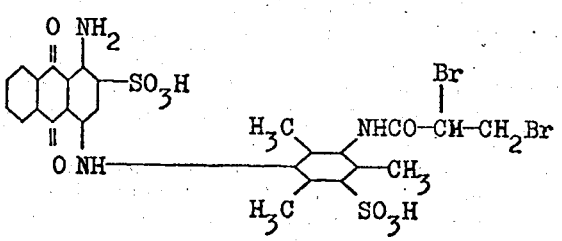

blue 24 parts of isophorone, 3 parts of ammonium acetate and 2 parts of formic acid (85 % strength). The pH-value of the dyebath is 4.4. The skins are introduced into the bath at 60°C and dyed at this temperature for 1½ hours.

The non-fixed dyestuff is eluted by raising the pH-value of the dyebath to 8–8.5 by means of 3 parts of ammonia (24 % strength). Thereafter, the dyed sheepskins are acidified with 1 part of 80 % strength acetic acid and greased with 3 parts of a sulphated sperm oil.

An evenly dyed skin of a blue-green shade is obtained.

EXAMPLE 2

100 parts of chrome-tanned sheepskins are neutralised as in Example 1 and then treated with a liquor which contains in 2000 parts of water, 4 parts of the dyestuff mixture of 30 parts of the chromium-containing monoazo dyestuff 2-aminophenol-4-sulphonic acid-N-methylamide → β-naphthol (dyestuff:chromium = 2:1), 10 parts of the chromium-containing monoazo dyestuff 2-amino-4-nitro-6-acetylaminophenol → 2-hydroxy-8-acetylaminonaphthalene (dyestuff:chromium = 2:1) and 60 parts of the cobalt-containing monoazo dyestuff 2-aminophenol-4-sulphonic acid-N-methylamide → 1-*p*-chlorophenyl-3-methylpyrazolone (dyestuff:cobalt = 2:1), and 24 parts of acetophenone, 2 parts of the condensation product of naphthalenesulphonic acid and formaldehyde, 1 part of a mixture of a) the adduct of 1 mol of tallow fatty amine and 20 mols of ethylene oxide, quaternised with dimethylsulphate, and b) the ammonium salt of the acid sulphuric acid ester of the adduct of 1 mol of a fatty amine (10 % stearylamine, 55 % arachidylamine and 35 % behenylamine) and 30 mols of ethylene oxide, and 2 parts of formic acid (85 % strength). The pH-value of the dyebath is 3.8. The skins are introduced into the bath at 60°C and dyed at this temperature for 1 hour. The sheepskins are subsequently greased, in the same bath, with 3 parts of a sulphated sperm oil.

The dyed skin shows a medium brown shade.

EXAMPLE 3

100 parts of chrome-tanned sheepskins are neutralised as in Example 1 and then treated with a liquor which contains in 2000 parts of water, 4 parts of a dyestuff mixture of 1 part of C.I. Acid Red 183 and 1 part of C.I. Acid Red 195, 6 parts of methylcyclohexanone, 1 part of the reaction product of *p*-nonylphenol and 9 mols of ethylene oxide and 2 parts of formic acid (85 % strength). The pH-value of the dyeing liquor is 3.8. The skins are introduced into the bath at 60°C and dyed at this temperature for 1 hour. Thereafter, the skins are greased in the same bath with 3 parts of a sulphated sperm oil. A skin dyed uniformly red is obtained.

EXAMPLE 4

100 parts of chrome-tanned sheepskins are neutralised as in Example 1 and then treated with a liquor which contains in 2000 parts of water, 4 parts of the 1:2 cobalt complex dyestuff with the dyestuff molecules

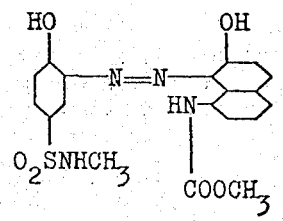

and

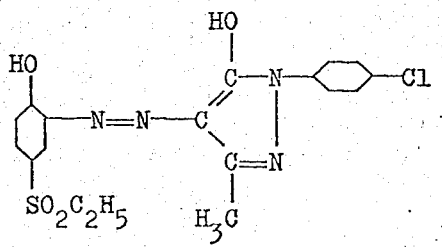

6 parts of 3,3,6,8-tetramethyltetralone-(1), 1 part of the reaction product of *p*-nonylphenol and 9 mols of ethylene oxide, 2 parts of the condensation product of naphthalenesulphonic acid and formaldehyde, 1 part of a mixture of a) the adduct of 1 mol of tallow fatty amine and 20 mols of ethylene oxide, quaternised with dimethyl sulphate and b) the ammonium salt of the acid sulphuric acid ester of the adduct of 1 mol of a fatty amine (10 % of stearylamine, 55 % of arachidylamine and 35 % of behenylamine) and 30 mols of ethylene oxide, and 2 parts of formic acid (85 % strength). The pH-value of the liquor is 3.8. The skins are introduced into the bath at 60°C and dyed at this temperature for 1 hour. Thereafter they are greased in the same bath with 3 parts of a sulphated sperm oil. The sheepskin shows an even red-brown dyeing.

EXAMPLE 5

100 parts of chrome-tanned rabbit skins are milled for 2 hours at 40°C in a bath which contains 1 part of the reaction product of *p*-nonylphenol with 9 mols of ethylene oxide, 4 parts of sodium hydrosulphite and 4 parts of anhydrous sodium carbonate in 2000 parts of water, and are subsequently rinsed.

The rabbit skins pretreated in this way are dyed in 2000 parts of water which contain 3 parts of the dyestuff C.I. Reactive Yellow 14, 12 parts of butyl acetate, 2 parts of acetic acid (80 % strength), and 2 parts of the addition product of 8 mols of ethylene oxide to oleylamine.

The pH-value of the dyebath is 4.3. The skins are introduced into the bath at 60°C and dyed at this temperature for 1½ hours. They are subsequently rinsed and dried.

A skin dyed an even yellow of good colour intensity is obtained.

EXAMPLE 6

100 parts of chrome-tanned rabbit skins, which have been pretreated according to Example 5, are dyed for 1½ hours in an aqueous dyebath at 60°C, using a liquor ratio of 1:20.

The liquor contains: 3 parts of the dyestuff of formula

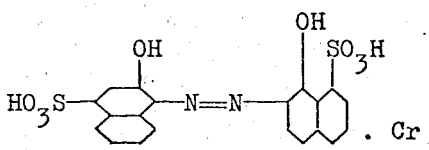

blue 30 parts of benzaldehyde, 2 parts of acetic acid (80 % strength) and 2 parts of a mixture of a) the adduct of 1 mol of tallow fatty amine and 7 mols of ethylene oxide, quaternised with chloracetamide, and b) the ammonium salt of the acid sulphuric acid ester of the unquaternised adduct a). The pH-value of the dyebath is 4.5. Thereafter the skins are rinsed and dried.

The dyed skin shows a blue shade of good evenness. Instead of benzaldehyde, 20 % of tetralone or 24 % of isophorone can also be added to the dyebath, and good results are again obtained.

EXAMPLE 7

100 parts of chrome-tanned sheepskins are neutralised for 1 hour at 40°C, on a winch, in a bath which contains 1 part of the reaction product of *p*-nonylphenol and 9 parts of ethylene oxide, 5 parts of sodium hydrosulphite and 2 parts of ammonia (24 % strength) in 2000 parts of water.

The sheepskins pretreated in this way are dyed in 2000 parts of water which contain 3 parts of the dyestuff of formula

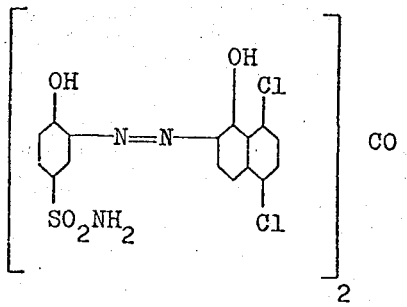

CO claret 12 parts of butyl acetate, 2 parts of the condensation product of naphthalenesulphonic acid and formaldehyde, 1 part of a mixture of a) the adduct of 1 mol of tallow fatty amine and 20 mols of ethylene oxide, quaternised with dimethylsulphate, and b) the ammonium salt of the acid sulphuric acid ester of the adduct of 1 mol of a fatty amine (10 % of stearylamine, 53 % of arachidylamine and 35 % of behenylamine) and 30 mols of ethylene oxide, and 2 parts of formic acid (85 % strength).

The pH-value of the dyebath is 3.7. The skins are introduced into the bath at 60°C and dyed for 1½ hours at this temperature. Thereafter they are rinsed and dried.

Good results are also obtained if instead of the abovementioned dyestuff 4 parts of the dyestuff of formula

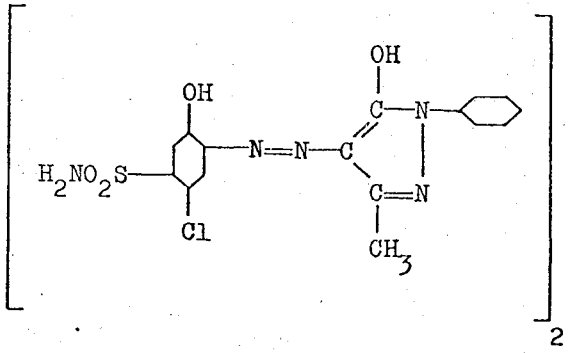

Cr red are employed, and instead of butyl acetate 30 parts of benzaldehyde are employed.

EXAMPLE 8

100 parts of chrome-tanned sheepskins, which have been pretreated according to Example 1, are dyed for 1½ hours at 60°C in an aqueous dyebath and using a liquor ratio of 1:20.

The liquor contains: 3 parts of the dyestuff of formula

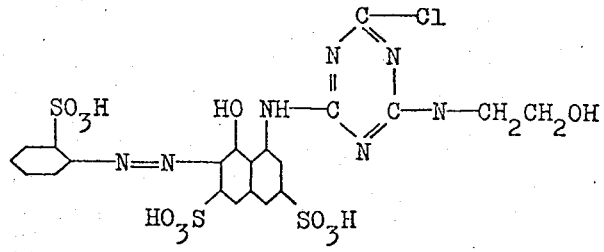

red.

24 parts of isophorone, 3 parts of acetic acid (80 % strength) and 2 parts of the addition product of 8 mols of ethylene oxide to 1 mol of oleylamine.

The pH-value of the dyebath is 4.1. The skins are subsequently rinsed and dried. A skin dyed in an even red of good colour intensity is obtained.

EXAMPLE 9

100 parts of chrome-tanned sheepskins, which have been pretreated according to Example 1, are dyed for 1½ hours at 62°C in an aqueous dyebath and at a liquor ratio of 1:20.

The liquor contains: 4 parts of the dyestuff of formula

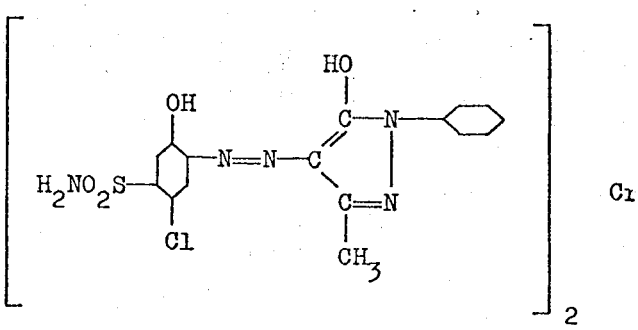

Cr red 30 parts of acetanilide, 2 parts of formic acid (85 % strength) 2 parts of the condensation product of naphthalenesulphonic acid and formaldehyde, and 1 part of a mixture of a) the adduct of 1 mol of tallow fatty amine and 20 mols of ethylene oxide, quaternised with dimethylsulphate and b) the ammonium salt of the acid sulphuric acid ester of the adduct of 1 mol of a fatty amine (10 % of stearylamine, 55 % of arachidylamine and 35 % of behenylamine) and 30 mols of ethylene oxide. The pH-value of the dyebath is 3.9. The skins are subsequently rinsed and dried. The sheepskin is dyed an even red, with good colour yield.

EXAMPLE 10

100 parts of chrome-tanned sheepskins are neutralised for 1 hour at 40°C, on a winch, in a bath which contains 5 parts of sodium hydrosulphite and 2 parts of ammonia (24 % strength) in 2000 parts of water.

The skins prevented in this way are dyed for 1½ hours at 60°C in an aqueous dyebath and using a liquor ratio of 1:20.

The liquor contains: 3 parts of the dyestuff of formula

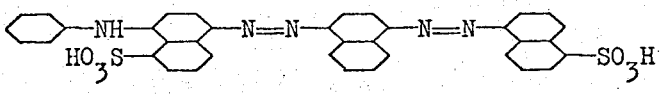

black 12 parts of butyl acetate, 1 part of the reaction product of *p*-nonylphenol and 9 mols of ethylene oxide, 2 parts of the reaction product of oleylamine and 8 mols of ethylene oxide and 2 parts of formic acid (85 % strength). The pH-value of the liquor is 3.6. The skins are subsequently rinsed and dried. The sheepskin shows an even blue dyeing of intense colour.

I claim:

1. An exhaust process for dyeing skins and furs, comprising the step of applying to the skin or fur, in a goods-to-liquor ratio of 1:10 to 1:40, at a temperature in the range of 55° to 70°C, an aqueous dye bath having a pH of 3 to 6 which contains water, a water-soluble wool dyestuff, and 0.75 to 15 grams of a non-ionisable organic compound selected from the group consisting of isophorone and tributylphosphate, per liter of aqueous dyebath.

2. The process of claim 1, wherein the aqueous dye bath contains 6 to 12 grams of the non-ionisable organic compound per liter.

3. The process of claim 1, wherein the aqueous dye bath contains from 0.75 to 4 grams of the non-ionisable organic compound per liter and additionally contains an emulsifier.

4. The process of claim 3, wherein the emulsifier is a reaction product of fatty alcohol or alkylphenol with ethylene oxide.

5. The process of claim 1, wherein the dyestuff is a 1:2-chromium complex of cobalt complex dyestuff, which is free from sulfonic acid groups and free from carboxylic acid groups which do not participate in the complex formation.

6. The process of claim 1, wherein the dyestuff is a fiber-reactive dyestuff, containing as the reactive grouping, an acrylamide or α-halogenacrylamide group, or grouping convertible thereto.

7. The process of claim 1, wherein the temperature is in the range of 55° to 60°C.

8. The process of claim 1, wherein the pH is in the range of 3.5 to 5.

9. The process of claim 1, wherein sheepskins are dyed.

10. The process of claim 1, wherein the non-ionisable organic compound is isophorone.

11. The process of claim 1, wherein the non-ionisable organic compound is tributylphosphate.

* * * * *